US011538393B2

(12) United States Patent
Xiong

(10) Patent No.: US 11,538,393 B2
(45) Date of Patent: Dec. 27, 2022

(54) TEXT BOUNDARY PROCESSING METHOD, DISPLAY PANEL, AND COMPUTER-READABLE STORAGE MEDIUM

(71) Applicants: BEIHAI HKC OPTOELECTRONICS TECHNOLOGY CO., LTD., Beihai (CN); CHONGQING HKC OPTOELECTRONICS TECHNOLOGY CO., LTD., Chongqing (CN)

(72) Inventor: Zhi Xiong, Beihai (CN)

(73) Assignees: BEIHAI HKC OPTOELECTRONICS TECHNOLOGY CO., LTD., Beihai (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/201,208

(22) Filed: Mar. 15, 2021

(65) Prior Publication Data

US 2021/0201747 A1 Jul. 1, 2021

Related U.S. Application Data

(63) Continuation of application No. PCT/CN2020/093311, filed on May 29, 2020.

(30) Foreign Application Priority Data

Jun. 12, 2019 (CN) ..... 201910508239.2

(51) Int. Cl.
*G09G 3/20* (2006.01)
*G09G 5/30* (2006.01)

(52) U.S. Cl.
CPC ..... *G09G 3/2074* (2013.01); *G09G 5/30* (2013.01); *G09G 2320/02* (2013.01)

(58) Field of Classification Search
CPC ..... G09G 3/2074; G09G 5/30
See application file for complete search history.

(56) References Cited

U.S. PATENT DOCUMENTS 10,192,286 B2 1/2019 Furihata et al.
2003/0137522 A1 7/2003 Kaasila et al.
(Continued)

FOREIGN PATENT DOCUMENTS

CN 1400807 A 3/2003
CN 101140750 A 3/2008
(Continued)

OTHER PUBLICATIONS

First Office Action issued in counterpart Chinese Patent Application No. 201910508239.2, dated Mar. 4, 2021.
(Continued)

*Primary Examiner* — Roy P Rabindranath
(74) *Attorney, Agent, or Firm* — Westbridge IP LLC

(57) ABSTRACT

Disclosed are a text boundary processing method, a display panel and a computer-readable storage medium. The method includes: acquiring a grayscale value of each sub-pixel in a display panel; determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, where, the sub-pixel group consists of the current sub-pixel and two sub-pixels adjacent to the current sub-pixel in a same row where the current sub-pixel is located.

20 Claims, 4 Drawing Sheets

(56) References Cited

U.S. PATENT DOCUMENTS

| | | | | |
|---|---|---|---|---|
| 2012/0281030 | A1* | 11/2012 | Miyata | G09G 3/3688 345/690 |
| 2013/0222407 | A1 | 8/2013 | Matskewich et al. | |
| 2014/0306957 | A1* | 10/2014 | Herrick | G09G 5/00 345/422 |
| 2016/0307492 | A1 | 10/2016 | Kim | |
| 2017/0270359 | A1 | 9/2017 | Ouchi et al. | |

FOREIGN PATENT DOCUMENTS

| | | | | |
|---|---|---|---|---|
| CN | 101489143 | A | | 7/2009 |
| CN | 101527127 | A | | 9/2009 |
| CN | 103226829 | A | | 7/2013 |
| CN | 103956134 | A | | 7/2014 |
| CN | 104916246 | A | | 9/2015 |
| CN | 106446908 | A | | 2/2017 |
| CN | 107564047 | A | | 1/2018 |
| CN | 108122525 | A | | 6/2018 |
| CN | 108154848 | A | | 6/2018 |
| CN | 108231019 | A | | 6/2018 |
| CN | 110349530 | A | | 10/2019 |
| CN | 106446908 | | * | 2/2022 |

OTHER PUBLICATIONS

International Search Report and Written Opinion issued in corresponding PCT Application No. PCT/CN2020/093311, dated Aug. 20, 2020.

Examination Report issued in counterpart Indian Patent Application No. 202227001678, dated Jun. 8, 2022.

* cited by examiner

TEXT BOUNDARY PROCESSING METHOD, DISPLAY PANEL, AND COMPUTER-READABLE STORAGE MEDIUM

CROSS REFERENCE TO RELATED APPLICATIONS

This disclosure is a Continuation Application of PCT Application No. PCT/CN2020/093311, filed on May 29, 2020, which claims the benefit of Chinese Patent Application No. 201910508239.2, filed on Jun. 12, 2019 and entitled "TEXT BOUNDARY PROCESSING METHOD, DISPLAY PANEL, AND COMPUTER-READABLE STORAGE MEDIUM". The disclosures of the aforementioned applications are hereby incorporated by reference in their entireties.

TECHNICAL FIELD

This disclosure relates to the field of display technology, in particular to a text boundary processing method, a display panel, and a computer-readable storage medium.

BACKGROUND

The statements here only provide background information related to the present disclosure, and do not necessarily constitute prior art.

The display panel connects the Printed Circuit Board (PCB), Source Driver IC and optical film (LCD CELL) through bonding technology to form a display system.

In the design of the whole machine, the text display on the display panel is displayed by the pixels arranged in an array on the display panel, and the pixels includes red sub-pixels, green sub-pixels, and blue sub-pixels arranged in sequence. However, in the actual display of the text boundary area, it is prone to appear different from the general sub-pixel arrangement, that is, the original sequential sub-pixel arrangement appears irregular, resulting in unclear text boundary display.

SUMMARY

This disclosure provides a text boundary processing method, including:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group is composed of the current sub-pixel and two sub-pixels adjacent to the current sub-pixel in a same row where the current sub-pixel is located.

This disclosure further provides a display panel, including: a memory, a control circuit board, and a text boundary processing program stored on the memory and operable on the control circuit board, the following operations are implemented when the text boundary processing program is executed by the control circuit board:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group is composed of the current sub-pixel and two sub-pixels adjacent to the current sub-pixel in a same row where the current sub-pixel is located.

This disclosure further provides a computer-readable storage medium, where the computer-readable storage medium stores a text boundary processing program, and the following operations are implemented when the text boundary processing program is executed by a control circuit board:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group is composed of the current sub-pixel and two sub-pixels adjacent to the current sub-pixel in a same row where the current sub-pixel is located.

BRIEF DESCRIPTION OF THE DRAWINGS

In order to more clearly describe the technical solutions in the embodiments of this disclosure or exemplary description, the following will briefly introduce the drawings that need to be used in the description of the embodiments or exemplary description. Obviously, the drawings in the following description are only some embodiments of this disclosure. For those of ordinary skill in the art, without creative work, other drawings can be obtained according to these drawings.

Figure 1:
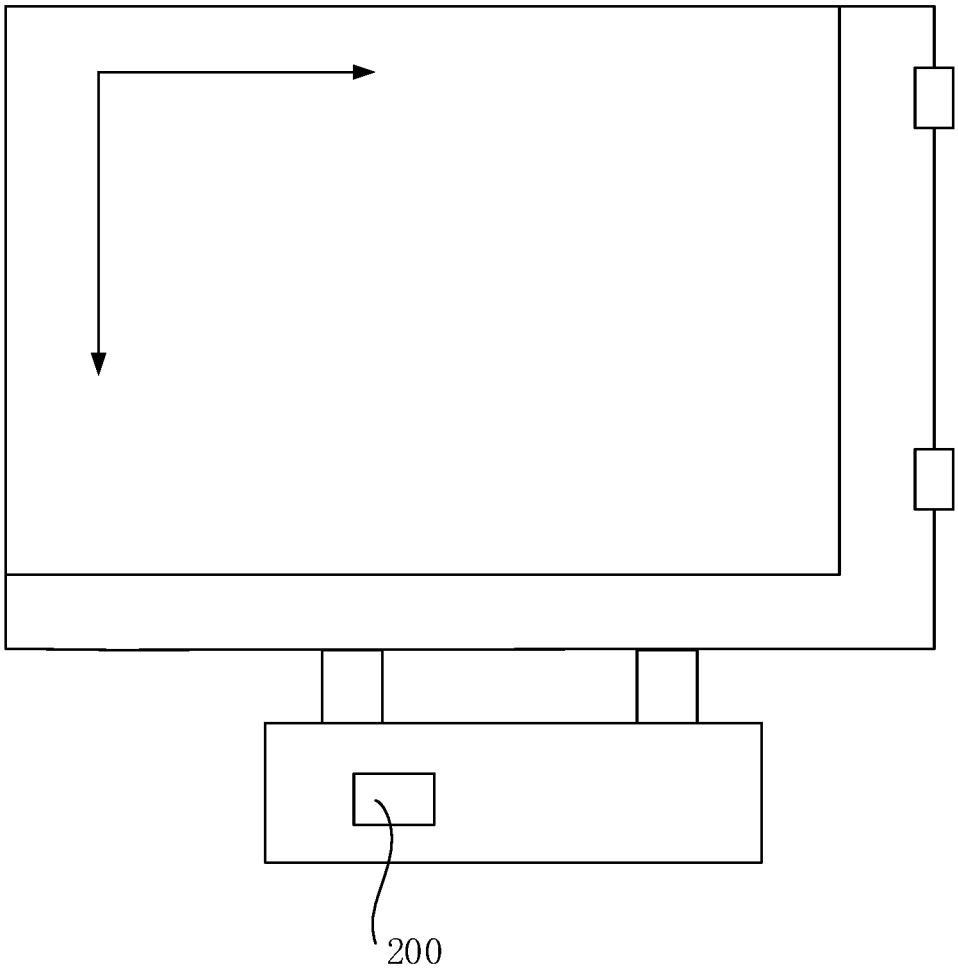
FIG. 1 is a schematic structural diagram of a display panel according to an embodiment of this disclosure.

The realization of the object of this disclosure, functional characteristics, and advantages will be further described in conjunction with the embodiments and with reference to the accompanying drawings.

DETAILED DESCRIPTION OF THE EMBODIMENTS

It should be understood that the specific embodiments described herein are only used to explain this disclosure, and are not used to limit this disclosure.

A solution of the embodiments of this disclosure is:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group consists of the current sub-pixel and two sub-pixels adjacent to the current sub-pixel in a same row where the current sub-pixel is located.

In an exemplary embodiment of displaying text on the display panel, the text display on the display panel is displayed by the pixels arranged in an array on the display panel, and the pixels includes red sub-pixels, green sub-pixels, and blue sub-pixels arranged in sequence. However, in the actual display of the text boundary area, it is prone to appear different from the general sub-pixel arrangement, that is, the original sequential sub-pixel arrangement appears irregular, resulting in unclear text boundary display.

According to the technical solutions provided by this disclosure, in a determination that the current sub-pixel in the display panel is the text boundary, the grayscale values of the red and blue sub-pixels in the sub-pixel group where the current sub-pixel is located are interchanged, that is, the grayscale value with larger brightness is assigned to the text boundary, so as to make the text boundary determined by the current sub-pixel display clear and improve the display quality of the display panel.

Some embodiments of this disclosure provide a display panel. When the display panel displays text, it is determined whether each sub-pixel in the display panel is a sub-pixel that forms the text boundary, in a determination that a sub-pixel is the text boundary, the grayscale values of the red and blue sub-pixels in the sub-pixel group consisting of the sub-pixel and two sub-pixels adjacent to the sub-pixel in a same row where the sub-pixel is located can be interchanged, so as to make the text boundary determined by the sub-pixel display clear and improve the display quality of the display panel.

In an embodiment, the display panel may be a Twisted Nematic (TN) panel, a Vertical Alignment (VA) panel, an In-Plane Switching (IPS) panel, a Continuous Pinwheel Alignment (CPA) panel, an Advanced Super Dimension Switch (ADSDS) panel, a liquid crystal display panel, an LED panel, an OLED panel, a QLED panel, a curved panel, etc., which is not limited in this disclosure.

Figure 2:
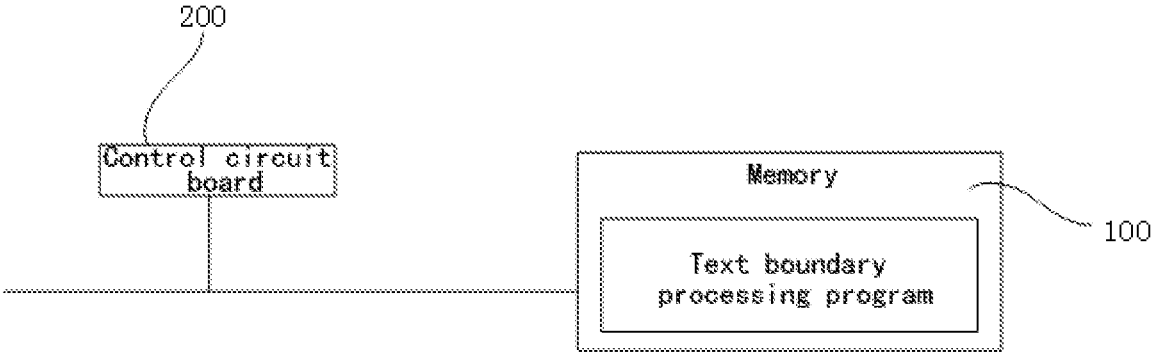
FIG. 2 is a schematic diagram of a hardware structure of a controller of the display panel according to an embodiment of this disclosure.

Referring to FIGS. 1 to 2, this disclosure provides a display panel.

In an embodiment, the display panel includes a memory 100, a control circuit board 200, and a text boundary processing program stored on the memory 100 and operable on the control circuit board 200, where, the memory 100 can be high-speed RAM memory or non-volatile memory, such as disk memory. The memory 100 may optionally also be a storage device independent of the aforementioned processor 4001. The control circuit board 200 includes, but is not limited to, a data drive control circuit board or a data drive chip or a data drive circuit.

Further, the arrow in the display panel shown in FIG. 1 indicates a scanning direction of the data drive chip.

Where, the following operations are implemented when the text boundary processing program is executed by the control circuit board 200:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group consists of the current sub-pixel and two sub-pixels adjacent to the current sub-pixel in a same row where the current sub-pixel is located.

Those skilled in the art may understand that the structure of the device shown in FIG. 2 does not constitute a limitation on the device, and more or less components than those illustrated may be included, or certain components may be combined, or different components may be arranged.

As shown in FIG. 2, the memory 100 as a computer-readable storage medium may include a text boundary processing program. The control circuit board 200 shown in FIG. 2 can be configured for invoking the text boundary processing program stored on the memory 100, and perform the following operations of the text boundary processing method in the following embodiments:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group consists of the current sub-pixel and two sub-pixels adjacent to the current sub-pixel in a same row where the current sub-pixel is located.

Referring to FIGS. 3 to 8, this disclosure provides a text boundary processing method.

Figure 3:
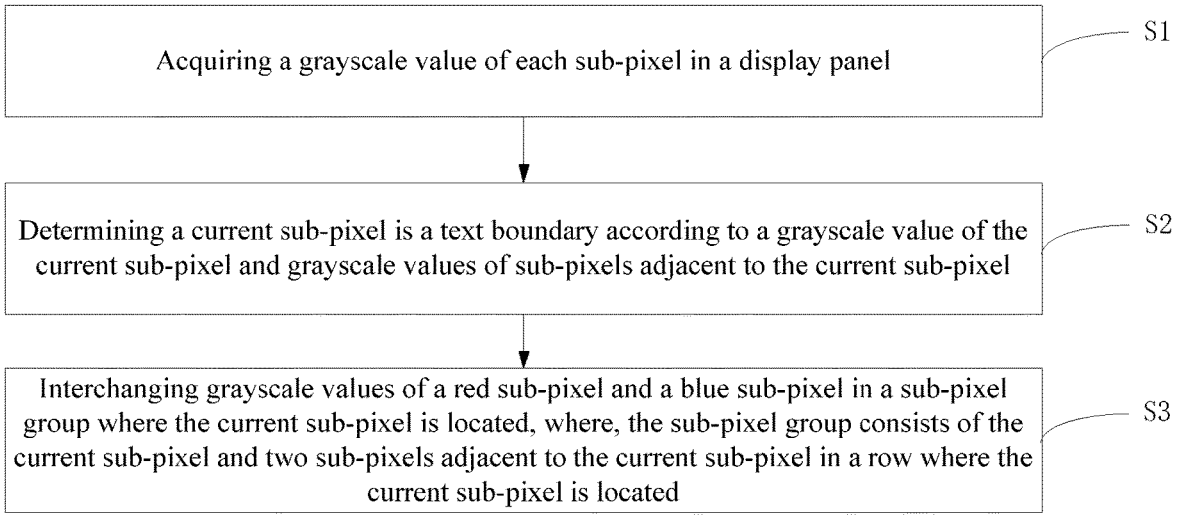
FIG. 3 is a flow chart of a text boundary processing method according to a first embodiment of this disclosure.

According to a first embodiment of the text boundary processing method provided by this disclosure, as shown in FIG. 3, the text boundary processing method includes the following operations:

S1. Acquiring a grayscale value of each sub-pixel in a display panel.

In this operation, the grayscale value of each sub-pixel in the display panel is acquired. Where, the display panel includes a plurality of pixels arranged in an array, each pixel includes a red sub-pixel, a green sub-pixel and a blue sub-pixel arranged in sequence, that is, in this operation, grayscale values of all red sub-pixels, green sub-pixels and blue sub-pixels in the display panel need to be acquired. The grayscale value ranges from 0 to 255, where 0 represents the darkest state of a sub-pixel and 255 represents the brightest state of a sub-pixel.

S2. Determining a current sub-pixel is a text boundary according to a grayscale value of the current sub-pixel and grayscale values of sub-pixels adjacent to the current sub-pixel.

In this operation, in response to acquiring the grayscale value of each sub-pixel, it is determined whether the current sub-pixel is the text boundary according to the grayscale value of the current sub-pixel and the grayscale values of the sub-pixels adjacent to the current sub-pixel.

Further, each sub-pixel of the display panel except the most edge sub-pixel has adjacent sub-pixels located in four directions: upper, lower, left and right. When the value of the current sub-pixel is acquired, a number of a row where the current sub-pixel is located, a number of a column where the current sub-pixel is located, and a grayscale value of the current sub-pixel can be acquired. Assuming that the current sub-pixel is (a, b, c), where, a is the number of the row where the current sub-pixel is located, b is the number of the column where the current sub-pixel is located, and c is a type of the current sub-pixel. The value ranges of a and b are related to the resolution of the display panel and are not limited here. When c is 1, the current sub-pixel is a red sub-pixel, and when c is 2, the current sub-pixel is a green sub-pixel, and when c is 3, the current sub-pixel is a blue sub-pixel.

That is, when c is 1, the current sub-pixel is a red sub-pixel, and the current sub-pixel is (a, b, 1). The adjacent coordinates of the red sub-pixel according to the upper, lower, left and right positions are (a−1, b, 1), (a+1, b, 1), (a, b−1, 3) and (a, b, 2), where, (a−1, b, 1) and (a+1, b, 1) are red sub-pixels of pixels in a same column as and adjacent to a pixel where the red sub-pixel is located, (a, b−1,3) is a blue sub-pixel of a pixel in a same row as and adjacent to a left of a pixel where the red sub-pixel is located, and (a, b, 2) is a green sub-pixel of the pixel where the red sub-pixel is located.

When c is 2, the current sub-pixel is a green sub-pixel, and the current sub-pixel is (a, b, 2). The adjacent coordinates of the green sub-pixel according to the upper, lower, left and right positions are (a−1, b, 2), (a+1, b, 2), (a, b, 1) and (a, b, 3), where, (a−1, b, 2) and (a+1, b, 2) are green sub-pixels of pixels in a same column as and adjacent to a pixel where the green sub-pixel is located, (a, b, 1) and (a, b, 3) are red and blue sub-pixels of the pixel where the red sub-pixel is located.

When c is 3, the current sub-pixel is a blue sub-pixel, and the current sub-pixel is (a, b, 3). The adjacent coordinates of the blue sub-pixel according to the upper, lower, left and right positions are (a−1, b, 3), (a+1, b, 3), (a, b, 2) and (a, b+1, 1), where, (a−1, b, 3) and (a+1, b, 3) are blue sub-pixels of pixels in a same column as and adjacent to a pixel where the blue sub-pixel is located, (a, b, 2) is a green sub-pixel of the pixel where the blue sub-pixel is located, (a, b+1, 1) is a red sub-pixel of a pixel in a same row as and adjacent to a right of the pixel where the blue sub-pixel is located.

That is, after determining the current sub-pixel and the sub-pixels adjacent to the current sub-pixel, it is determined whether the current sub-pixel is a text boundary according to the grayscale value of the current sub-pixel and the grayscale values of the sub-pixels adjacent to the current sub-pixel.

S3. Interchanging grayscale values of a red sub-pixel and a blue sub-pixel in a sub-pixel group where the current sub-pixel is located, where, the sub-pixel group consists of the current sub-pixel and two sub-pixels adjacent to the current sub-pixel in a row where the current sub-pixel is located.

In this operation, in a determination that the current sub-pixel is the text boundary, grayscale values of a red sub-pixel and a blue sub-pixel in a sub-pixel group where the current sub-pixel is located are interchanged, where, the sub-pixel group consists of the current sub-pixel and two sub-pixels adjacent to the current sub-pixel in a same row where the current sub-pixel is located. That is, in a determination that the current sub-pixel is the text boundary, the current sub-pixel and the two sub-pixels adjacent to the current sub-pixel in the row where the current sub-pixel is located form a sub-pixel group. When the current sub-pixel is a red sub-pixel, that is, the sub-pixel group is arranged in order of blue, red, and green sub-pixels. When the current sub-pixel is a green sub-pixel, that is, the sub-pixel group is arranged in order of red, green, and blue sub-pixels. When the current sub-pixel is a blue sub-pixel, the sub-pixel group is arranged in order of green, blue, and red sub-pixels.

Further, the grayscale values of the red sub-pixel and the blue sub-pixel in the sub-pixel group are interchanged, so as to make the text boundary determined by the sub-pixel display clear and improve the display quality of the display panel.

According to the embodiments of this disclosure, the following operation are carried out: acquiring a grayscale value of each sub-pixel in a display panel; determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, where, the sub-pixel group consists of the current sub-pixel and two sub-pixels adjacent to the current sub-pixel in a same row where the current sub-pixel is located. According to the technical solutions provided by this disclosure, in a determination that the current sub-pixel in the display panel is the text boundary, the grayscale values of the red and blue sub-pixels in the sub-pixel group where the current sub-pixel is located are interchanged, that is, the grayscale value with larger brightness is assigned to the text boundary, so as to make the text boundary determined by the current sub-pixel display clear and improve the display quality of the display panel.

Figure 4:
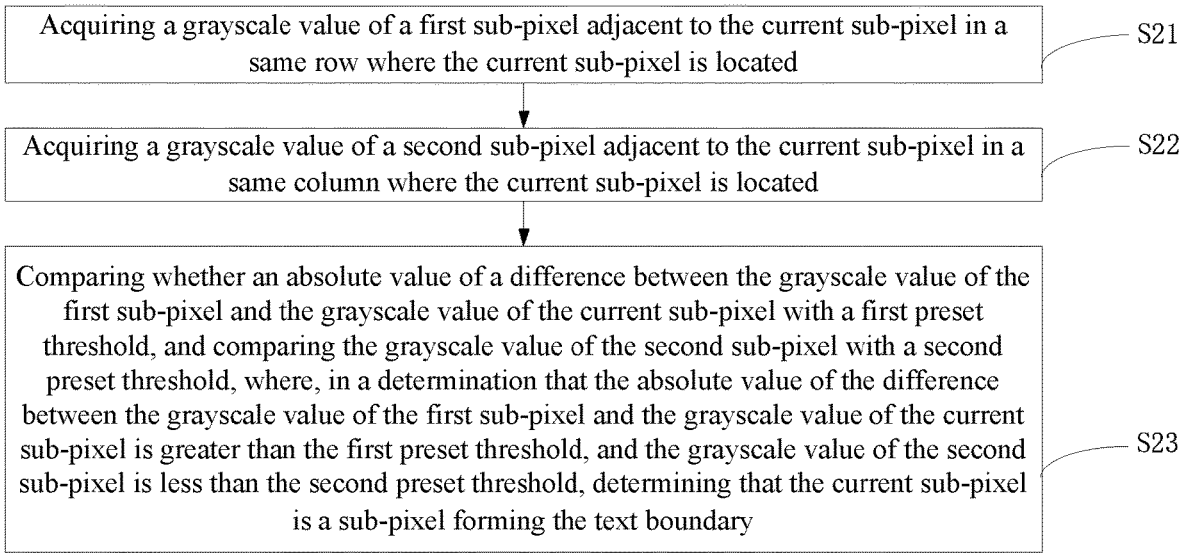
FIG. 4 is a flow chart of the text boundary processing method according to a second embodiment of this disclosure.

Based on the first embodiment, a second embodiment of the text boundary processing method is provided by this disclosure, as shown in FIG. 4, the operation S2 further includes:

S21. Acquiring a grayscale value of a first sub-pixel adjacent to the current sub-pixel in a same row where the current sub-pixel is located.

S22. Acquiring a grayscale value of a second sub-pixel adjacent to the current sub-pixel in a same column where the current sub-pixel is located.

S23. Comparing whether an absolute value of a difference between the grayscale value of the first sub-pixel and the grayscale value of the current sub-pixel with a first preset threshold, and comparing the grayscale value of the second sub-pixel with a second preset threshold, where, in a determination that the absolute value of the difference between the grayscale value of the first sub-pixel and the grayscale value of the current sub-pixel is greater than the first preset threshold, and the grayscale value of the second sub-pixel is less than the second preset threshold, determining that the current sub-pixel is a sub-pixel forming the text boundary.

In an embodiment, the first sub-pixel adjacent to the current sub-pixel in a same row where the current sub-pixel is located is confirmed, and the second sub-pixel adjacent to the current sub-pixel in a same column where the current sub-pixel is located is acquired. That is, assuming that the current sub-pixel is (a, b, c), where, a is the number of the row where the current sub-pixel is located, b is the number of the column where the current sub-pixel is located, and c is a type of the current sub-pixel. The value ranges of a and b are related to the resolution of the display panel and are not limited here. When c is 1, the current sub-pixel is a red sub-pixel, and when c is 2, the current sub-pixel is a green sub-pixel, and when c is 3, the current sub-pixel is a blue sub-pixel.

That is, when c is 1, the current sub-pixel is a red sub-pixel, and the current sub-pixel is (a, b, 1). The first sub-pixels adjacent to the current sub-pixel in the row where the current sub-pixel is located are (a, b−1, 3) and (a, b, 2), respectively, and the second sub-pixels adjacent to the current sub-pixel in a same column where the current sub-pixel is located are (a−1, b, 1) and (a+1, b, 1), respectively.

When c is 2, the current sub-pixel is a green sub-pixel, and the current sub-pixel is (a, b, 2). The first sub-pixels adjacent to the current sub-pixel in the row where the current sub-pixel is located are (a, b, 1) and (a, b, 3), and the second sub-pixels adjacent to the current sub-pixel in a same column where the current sub-pixel is located are (a−1, b, 2) and (a+1, b, 2), respectively.

When c is 3, the current sub-pixel is a blue sub-pixel, and the current sub-pixel is (a, b, 3). The first sub-pixels adjacent to the current sub-pixel in the row where the current sub-pixel is located are (a, b, 2) and (a, b+1, 1), respectively, and the second sub-pixels adjacent to the current sub-pixel in a same column where the current sub-pixel is located are (a−1, b, 3) and (a+1, b, 3), respectively.

Further, after determining the first sub-pixel and the second sub-pixel, the grayscale values of the first sub-pixel and the second sub-pixel are acquired respectively. Where there are two first sub-pixels, and grayscale values of the two first sub-pixels are the same value or different values; and there are two second sub-pixels, and grayscale values of the two second sub-pixels are the same value or different values. The value range is 0 to 255, which is specifically determined according to the brightness of the pixel.

Further, an absolute value of a difference between the grayscale value of the first sub-pixel and the grayscale value of the current sub-pixel is compared with a first preset threshold, and the grayscale value of the second sub-pixel is compared with a second preset threshold, where, in a determination that the absolute value of the difference between the grayscale value of the first sub-pixel and the grayscale value of the current sub-pixel is greater than the first preset threshold, and the grayscale value of the second sub-pixel is less than the second preset threshold, it is determined that the current sub-pixel is a sub-pixel forming the text boundary. A value range of the first preset threshold is 30 to 100, and a value range of the second preset threshold is 30 to 100.

That is, in a determination that the absolute value of the difference between the grayscale value of the first sub-pixel and the grayscale value of the current sub-pixel is greater than the first preset threshold, and the grayscale value of the second sub-pixel is less than the second preset threshold, it is determined that the current sub-pixel is the sub-pixel that forms the text boundary. Since there are two first sub-pixels and two second sub-pixels, in a determination that the absolute value of the difference between the grayscale value of each first sub-pixel and the current sub-pixel is greater than the first preset threshold, and the grayscale value of each second sub-pixel is less than the second preset threshold, it is determined that the current sub-pixel is the sub-pixel that forms the text boundary.

Certainly, the sub-pixels at the most edge of the display panel have only two adjacent sub-pixels, or three adjacent sub-pixels. The sub-pixels located at the four vertices of the display panel have two adjacent sub-pixels, and the sub-pixels at the other edges have three adjacent sub-pixels. In this embodiment, the sub-pixels at the most edge of the display panel are not applied to determine whether they are the sub-pixels that form the text boundary.

Figure 5:
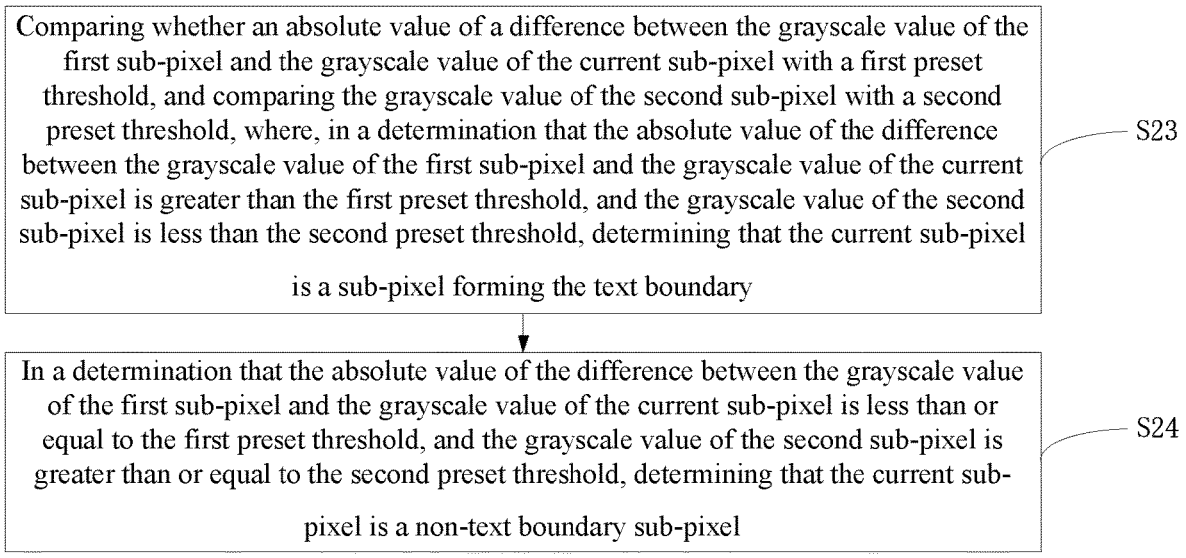
FIG. 5 is a flow chart of the text boundary processing method according to a third embodiment of this disclosure.

Based on the second embodiment, a third embodiment of the text boundary processing method is provided by this disclosure, as shown in FIG. 5, the operation S23 further includes:

S24. In a determination that the absolute value of the difference between the grayscale value of the first sub-pixel and the grayscale value of the current sub-pixel is less than or equal to the first preset threshold, and the grayscale value of the second sub-pixel is greater than or equal to the second preset threshold, determining that the current sub-pixel is a non-text boundary sub-pixel.

In this operation, an absolute value of a difference between the grayscale value of the first sub-pixel and the grayscale value of the current sub-pixel is compared with a first preset threshold, and the grayscale value of the second sub-pixel is compared with a second preset threshold, where, in a determination that the absolute value of the difference between the grayscale value of the first sub-pixel and the grayscale value of the current sub-pixel is less than or equal to the first preset threshold, and the grayscale value of the second sub-pixel is greater than or equal to the second preset threshold, it is determined that the current sub-pixel is a non-text boundary sub-pixel.

Further, when it is determined that the current sub-pixel is a non-text boundary sub-pixel, the current sub-pixel will not appear unclear display problem and may not be processed, that is, the normal data is output to the display panel.

Figure 6:
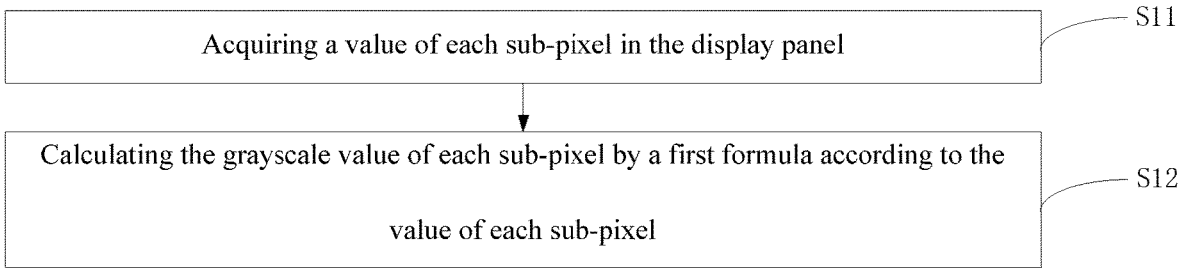
FIG. 6 is a flow chart of the text boundary processing method according to a fourth embodiment of this disclosure.

Based on the first embodiment, a fourth embodiment of the text boundary processing method is provided by this disclosure, as shown in FIG. 6, the operation S1 further includes:

S11. Acquiring a value of each sub-pixel in the display panel.

S12. Calculating the grayscale value of each sub-pixel by a first formula according to the value of each sub-pixel.

In an embodiment, a value of each sub-pixel in the display panel is acquired. Where, the display panel includes a plurality of pixels arranged in an array, each pixel includes a red sub-pixel, a green sub-pixel and a blue sub-pixel arranged in sequence, that is, in this operation, values of all red sub-pixels, green sub-pixels and blue sub-pixels in the display panel need to be acquired. Where, the value ranges from 0 to 255, where 0 represents the darkest state of a sub-pixel and 255 represents the brightest state of a sub-pixel.

Further, the grayscale value of each sub-pixel is calculated by a first formula according to the value of each sub-pixel, so that the grayscale value of each sub-pixel is converted and obtained. Where, the acquired sub-pixel is one of a red sub-pixel, a green sub-pixel and a blue sub-pixel. When the acquired sub-pixel is a red sub-pixel, the first formula is Gray=R*e, where, R is a value of the red sub-pixel, and e is a constant associated with the red sub-pixel with a value of 0.299; when the acquired sub-pixel is a green sub-pixel, the first formula is Gray=G*f, where, G is a value of the green sub-pixel, and f is a constant associated with the green sub-pixel with a value of 0.587; when the acquired sub-pixel is a blue sub-pixel, the first formula is Gray=B*g, where, B is a value of the blue sub-pixel, and g is a constant associated with the blue sub-pixel with a value of 0.114.

That is, in all embodiments of this disclosure, grayscale values of the red sub-pixels, the green sub-pixels and the blue sub-pixels can be acquired by the above calculation manner. The grayscale value of each sub-pixel in the display panel is calculated by the first formula, so as to determine the text boundary, and to provide a specific value for the adjustment of the sub-pixel that forms the text boundary, thereby making the text boundary display clearer.

Figure 7:
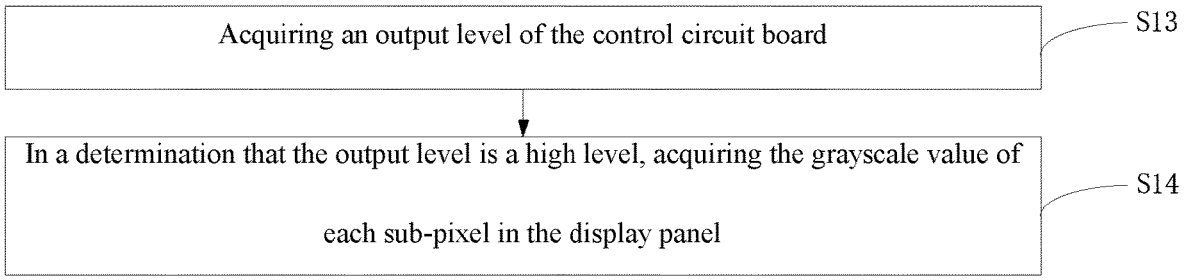
FIG. 7 is a flow chart of the text boundary processing method according to a fifth embodiment of this disclosure.

Based on all the above embodiments, this disclosure provides a fifth embodiment of the text boundary processing method. The display panel includes a control circuit board, where an output pin is connected to the control circuit board. As shown in FIG. 7, the operation S1 further includes:

S13. Acquiring an output level of the control circuit board.

S14. In a determination that the output level is a high level, acquiring the grayscale value of each sub-pixel in the display panel.

In an embodiment, an output level of the control circuit board is acquired. Where, the output level of the output pin on the control circuit board is acquired, and the output level includes a high level and a low level.

Further, in a determination that the output level is a high level, acquiring the grayscale value of each sub-pixel in the display panel. Where, the grayscale value of each sub-pixel in the display panel is acquired with reference to the content of the above-mentioned fourth embodiment, and details are not described herein again.

Further, in a determination that the output level is a low level, controlling the display panel to output an original grayscale value of each sub-pixel to the display panel for display.

Figure 8:
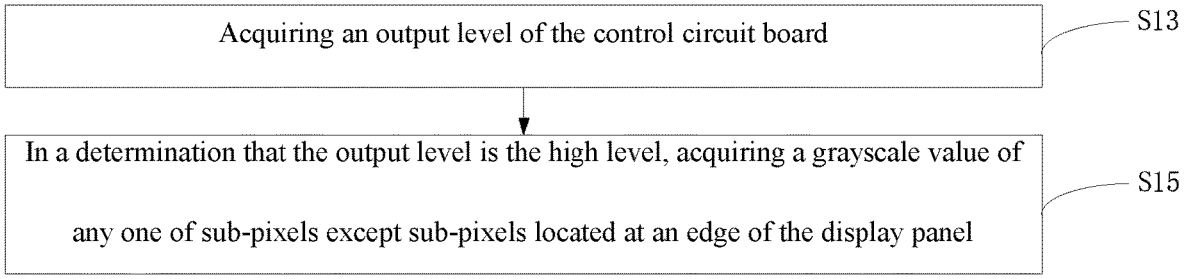
FIG. 8 is a flow chart of the text boundary processing method according to a sixth embodiment of this disclosure.

Based on the fifth embodiment, a sixth embodiment of the text boundary processing method is provided by this disclosure, as shown in FIG. 8, the operation S14 further includes:

S15. In a determination that the output level is the high level, acquiring a grayscale value of any one of sub-pixels except sub-pixels located at an edge of the display panel.

In this operation, in a determination that the output level is the high level, a grayscale value of any one of sub-pixels except sub-pixels located at an edge of the display panel is acquired. That is, the sub-pixels located at the edge of the display panel are not processed as text boundaries.

Further, since the sub-pixels at the most edge of the display panel have only two adjacent sub-pixels, or three adjacent sub-pixels; the sub-pixels located at the four vertices of the display panel have two adjacent sub-pixels, and the sub-pixels at the other edges have three adjacent sub-pixels, in this embodiment, the sub-pixels at the most edge of the display panel are not applied to determine whether they are the sub-pixels that form the text boundary.

Further, a grayscale value of any one of sub-pixels except sub-pixels located at an edge of the display panel is acquired with reference to the contents of the above-mentioned fourth and fifth embodiments, which are not described herein again.

The above is only optional embodiments of this disclosure, and thus does not limit the scope of this disclosure, and the equivalent structural transformation made by the content of the specification and the drawings of this disclosure, or directly/indirectly applied to other related technical fields are all included in the patent protection scope of this disclosure.

What is claimed is:

1. A text boundary processing method, comprising:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group consists of the current sub-pixel and two sub-pixels adjacent to the current sub-pixel in a same row where the current sub-pixel is located.

2. The text boundary processing method of claim 1, wherein, the operation of determining a current sub-pixel is a text boundary according to a grayscale value of the current sub-pixel and grayscale values of sub-pixels adjacent to the current sub-pixel comprises:

acquiring a grayscale value of a first sub-pixel adjacent to the current sub-pixel in a same row where the current sub-pixel is located;

acquiring a grayscale value of a second sub-pixel adjacent to the current sub-pixel in a same column where the current sub-pixel is located; and comparing an absolute value of a difference between the grayscale value of the first sub-pixel and the grayscale value of the current sub-pixel with a first preset threshold, and comparing the grayscale value of the second sub-pixel with a second preset threshold, wherein, in a determination that the absolute value of the difference between the grayscale value of the first sub-pixel and the grayscale value of the current sub-pixel is greater than the first preset threshold, and the grayscale value of the second sub-pixel is less than the second preset threshold, determining that the current sub-pixel is a sub-pixel forming the text boundary.

3. The text boundary processing method of claim 2, wherein there are two first sub-pixels, and grayscale values of the two first sub-pixels are the same value or different values.

4. The text boundary processing method of claim 2, wherein there are two second sub-pixels, and grayscale values of the two second sub-pixels are the same value or different values.

5. The text boundary processing method of claim 2, wherein, after the operation of comparing an absolute value of a difference between the grayscale value of the first sub-pixel and the grayscale value of the current sub-pixel with a first preset threshold, and comparing the grayscale value of the second sub-pixel with a second preset threshold, the method further comprises:

in a determination that the absolute value of the difference between the grayscale value of the first sub-pixel and the grayscale value of the current sub-pixel is less than or equal to the first preset threshold, and the grayscale value of the second sub-pixel is greater than or equal to the second preset threshold, determining that the current sub-pixel is a non-text boundary sub-pixel.

6. The text boundary processing method of claim 5, wherein a value range of the first preset threshold is not less than 30 and not greater than 100.

7. The text boundary processing method of claim 5, wherein a value range of the second preset threshold is not less than 30 and not greater than 100.

8. The text boundary processing method of claim 1, wherein the operation of acquiring a grayscale value of each sub-pixel in a display panel comprises:

acquiring a value of each sub-pixel in the display panel; and calculating the grayscale value of each sub-pixel by a first formula according to the value of each sub-pixel.

9. The text boundary processing method of claim 8, wherein, when the acquired sub-pixel is a red sub-pixel, the first formula is Gray=R*e, wherein, R is a value of the red sub-pixel, and e is a constant associated with the red sub-pixel with a value of 0.299.

10. The text boundary processing method of claim 8, wherein, when the acquired sub-pixel is a green sub-pixel, the first formula is Gray=G*f, wherein, G is a value of the green sub-pixel, and f is a constant associated with the green sub-pixel with a value of 0.587.

11. The text boundary processing method of claim 8, wherein, when the acquired sub-pixel is a blue sub-pixel, the first formula is Gray=B*g, wherein, B is a value of the blue sub-pixel, and g is a constant associated with the blue sub-pixel with a value of 0.114.

12. The text boundary processing method of claim 1, wherein the display panel comprises a control circuit board, and the operation of acquiring a grayscale value of each sub-pixel in a display panel comprises:

acquiring an output level of the control circuit board; and in a determination that the output level is a high level, acquiring the grayscale value of each sub-pixel in the display panel.

13. The text boundary processing method of claim 1, wherein the display panel comprises a control circuit board, and the operation of acquiring a grayscale value of each sub-pixel in a display panel comprises:

acquiring an output level of the control circuit board; and in a determination that the output level is a low level, controlling the display panel to output an original grayscale value of each sub-pixel to the display panel for display.

14. The text boundary processing method of claim 12, wherein the operation of in a determination that the output level is a high level, acquiring the grayscale value of each sub-pixel in the display panel comprises:

in a determination that the output level is the high level, acquiring a grayscale value of any one of sub-pixels except sub-pixels located at an edge of the display panel.

15. A display panel, comprising: a memory, a control circuit board, and a text boundary processing program stored on the memory and operable on the control circuit board, and the following operations are implemented when the text boundary processing program is executed by the control circuit board:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group consists of the current sub-pixel and two sub-pixels adjacent to the current sub-pixel in a same row where the current sub-pixel is located.

16. The display panel of claim 15, wherein, the operation of determining whether a current sub-pixel is a text boundary according to a grayscale value of the current sub-pixel and grayscale values of sub-pixels adjacent to the current sub-pixel comprises:

acquiring a grayscale value of a first sub-pixel adjacent to the current sub-pixel in a same row where the current sub-pixel is located;

acquiring a grayscale value of a second sub-pixel adjacent to the current sub-pixel in a same column where the current sub-pixel is located; and comparing whether an absolute value of a difference between the grayscale value of the first sub-pixel and the grayscale value of the current sub-pixel with a first preset threshold, and comparing the grayscale value of the second sub-pixel with a second preset threshold, wherein, in a determination that the absolute value of the difference between the grayscale value of the first sub-pixel and the grayscale value of the current sub-pixel is greater than the first preset threshold, and the grayscale value of the second sub-pixel is less than the second preset threshold, determining that the current sub-pixel is a sub-pixel forming the text boundary.

17. The display panel of claim 16, wherein, after the operation of comparing an absolute value of a difference between the grayscale value of the first sub-pixel and the grayscale value of the current sub-pixel with a first preset threshold, and comparing the grayscale value of the second sub-pixel with a second preset threshold, the following operations are further implemented:

in a determination that the absolute value of the difference between the grayscale value of the first sub-pixel and the grayscale value of the current sub-pixel is less than or equal to the first preset threshold, and the grayscale value of the second sub-pixel is greater than or equal to the second preset threshold, determining that the current sub-pixel is a non-text boundary sub-pixel.

18. The display panel of claim 15, wherein the operation of acquiring a grayscale value of each sub-pixel in a display panel comprises:

acquiring a value of each sub-pixel in the display panel; and calculating the grayscale value of each sub-pixel by a first formula according to the value of each sub-pixel.

19. The display panel of claim 15, wherein the display panel comprises a control circuit board, and the operation of acquiring a grayscale value of each sub-pixel in a display panel comprises:

acquiring an output level of the control circuit board; and in a determination that the output level is a high level, acquiring the grayscale value of each sub-pixel in the display panel.

20. A non-transitory computer-readable storage medium, wherein the non-transitory computer-readable storage medium stores a text boundary processing program, the following operations are implemented when the text boundary processing program is executed by a control circuit board:

acquiring a grayscale value of each sub-pixel in a display panel;

determining a current sub-pixel is a text boundary according to a grayscale value of the current sub-pixel and grayscale values of sub-pixels adjacent to the current sub-pixel; and interchanging grayscale values of a red sub-pixel and a blue sub-pixel in a sub-pixel group where the current sub-pixel is located, wherein, the sub-pixel group consists of the current sub-pixel and two sub-pixels adjacent to the current sub-pixel in a same row where the current sub-pixel is located.

* * * * *